United States Patent [19]

Kraüss et al.

[11] Patent Number: 4,542,991

[45] Date of Patent: Sep. 24, 1985

[54] MIXING SILO FOR PNEUMATICALLY HOMOGENIZING FINE-GRAINED OR DUST-LIKE MATERIAL

[75] Inventors: Werner Kraüss, Hamburg; Heinrich Vogt, Buxtehude, both of Fed. Rep. of Germany

[73] Assignee: Claudius Peters, Fed. Rep. of Germany

[21] Appl. No.: 559,421

[22] Filed: Dec. 8, 1983

[30] Foreign Application Priority Data

Dec. 9, 1982 [DE] Fed. Rep. of Germany ..... 3245542

[51] Int. Cl.[4] ..... B01F 13/02

[52] U.S. Cl. ..... 366/106; 222/195; 366/107

[58] Field of Search ..... 366/101, 106, 107, 102, 366/321; 222/195, 459; 261/64 R; 99/646 S; 406/90

[56] References Cited

U.S. PATENT DOCUMENTS

| | | | |
|---|---|---|---|
| 3,653,639 | 4/1972 | Mueller | 366/106 |
| 3,656,717 | 4/1972 | Klein | 366/106 |
| 4,239,421 | 12/1980 | Krauss | 366/107 |
| 4,364,665 | 12/1982 | Ahrens | 366/107 |
| 4,375,335 | 3/1983 | Klein | 366/107 |
| 4,472,062 | 9/1984 | Balzau | 222/195 |

*Primary Examiner*—Robert W. Jenkins
*Attorney, Agent, or Firm*—Eric P. Schellin

[57] ABSTRACT

Mixing silo for pneumatically homogenizing fine-grained or dust-like material, the bottom of which comprises groups of aeration zones which can be alternately supplied with compressed air in such a manner that in each group a bottom zone partially limited by the outer limit of the silo bottom is heavily aerated and a bottom zone located between the heavily aerated bottom zones is aerated only weakly. An even, progressive circulation of the entire silo contents with little expenditure of energy is achieved by separating the heavily aeratable bottom zones from each other with a star-shaped, exclusively weakly aeratable bottom zone and by constructing the outlet as an overflow.

6 Claims, 2 Drawing Figures

MIXING SILO FOR PNEUMATICALLY HOMOGENIZING FINE-GRAINED OR DUST-LIKE MATERIAL

The invention concerns a mixing silo for pneumatically homogenizing fine-grained or dust-like material, the bottom of which has groups of aeration zones which can be alternately supplied with compressed air and operated in such a manner that in each group a bottom zone partially limited by the outer limit of the silo bottom is heavily aerated and a bottom zone located between the heavily aerated bottom zones is aerated only weakly, and the outlet of which is located outside of the silo bottom.

A high-grade mixing method in which the loose material contained in a silo and fluidized by aeration is circulated by allowing it to rise over a heavily aerated bottom zone and to drop down over another, more weakly aerated bottom zone is designated as pneumatic homogenizing (German AS No. 1 138 608). Since homogenizing silos set up for circulating the entire silo contents require a lot of energy, mixing chamber silos (German AS No. 15 07 888) in conjunction with mixing bed apparatuses in front are often preferred, whereby the long-term adjustment of the silo contents depends primarily on mixing by gravity. However, mixing bed apparatuses are also very expensive. There was therefore a renewed interest in the homogenizing silo and the attempt was made to reduce its energy requirement by not constantly mixing the entire silo contents but rather only partial areas of the contents. In a known mixing silo a central bottom zone is constantly heavily aerated while from the ring of sectors two opposite sectors are weakly aerated in an alternating manner while the other sectors are not aerated (German AS No. 2 108 418). This does save a lot of energy, but the circulation of the material and therewith the mixing effect leave something to be desired. This is connected with the fact that the area of material to be put in motion over an aerated group of bottom zones is very narrow and high like a disklike part of the silo space and that very great restraints are therefore put on the movement of the surrounding masses of material. This again requires a comparatively great amount of energy to initiate a sufficiently even movement and there is also the danger that due to frictional restraints unpredictable parts of the material do not participate in the mixing movement or participate only to an unsatisfactory extent. This danger is particularly great in the outer areas of the silo space because long horizontal stretches must be traversed in the only weakly aerated areas of the material. Another disadvantage of the known silo is the fact that separations can not be excluded, as the flow conditions for the material in the outer areas and in the control area are very different. This could be counteracted only by using more energy, but this is precisely what should be avoided. Other systems are known in which the aeration of the bottom is restricted to a partial area consisting of an outer bottom sector and a central bottom zone and in which the circulation movement is likewise restricted to a disklike part of the silo volume. Even if this part does not extend diametrally through the entire silo space as in the precited construction, it is nevertheless laterally enclosed between dead masses of material and the material moving in it encounters great frictional resistance along with the resulting disadvantages described above (German No. 05 19 06 018; German patent No. 11 52 876).

Another reason for the loss of energy in known mixing silos is the fact that a considerable part of the air intended for fluidizing the material escapes through the outlet opening and is therefore lost.

The invention has the task of creating a silo of the type initially described which achieves a good homogenization with little expenditure of energy.

The solution of the invention consists of the fact that the exclusively weakly aeratable bottom zone separates the heavily aeratable bottom zones from each other in a star pattern and that the outlet is constructed as an overflow.

In contrast to the known silos, in which a heavily aerated outer bottom sector is extended linearly toward the silo center by the associated weakly aeratable bottom zone, the invention provides that the heavily aeratable bottom zone is surrounded where it is not limited by the silo wall on all sides by weakly aeratable bottom zones. This makes the spatial volume thereabove, in which the material moves as a result of the aeration, not disklike but rather compact in horizontal section. This has the consequence that the horizontal paths which the material must traverse from the weakly aerated areas into the heavily aerated area are relatively short. In addition, the frictional resistance of dead masses of material which limit the moved spatial volume on both sides does not have to be overcome in this movement. Non-aerated material is located in this instance exclusively at those limiting surfaces of the moved area of material where the material drops down over the weakly aerated zone. The invention also has the advantage that the loosening air is not lost through the opening of the material outlet near the bottom, where the critical horizontal movement from the weakly aerated to the heavily aerated zone occurs. It is known that the material outlet can be positioned outside of the actual aeration surface (German patent No. 11 52 876); in this instance, however, it is provided near the bottom in the silo wall or in a bottom part extended out via an opening in the silo wall. This excludes a continuous removal of the material during the mixing aeration which rotates from group to group in alternating fashion, because the material can only flow to the outlet if either the entire silo contents or at least the area of the silo contents adjacent to the outlet is constantly aerated. Moreover, a part of the loosening air supplied in the adjacent, heavily aerated bottom zone would be lost through the outlet if it were to be opened during the mixing operation, which would be contrary to the concept of the invention.

Said compact cross-sectional shaping of the spatial part subjected in accordance with the invention to a mixing movement contradicts a rule which has generally been observed in the past, namely, that a satisfactory circulating movement can only occur in a partial area of the silo if the ratio of the height to the diameter of the spatial part subjected to the mixing movement is not greater than approximately 1.5 to a maximum of 2. If the mixing space is too narrow in relation to its height, the downward movement of the material over the more weakly aerated zones is impeded by the material which is vehemently flowing up due to the heavy aeration, with the consequence that only a type of bubbling turbulence occurs and not a circulatory movement. If, however only a part of the silo contents which is compact in its cross section is circulated at the same height within the scope of the invention, very thin spatial conditions result for the circulatory area to be expected, for in comparison to the total silo area the transversal dimension of the area participating in the mixing is approximately halved. One would fear that a sufficient circulating movement would not occur. Surprizingly, the feared hemming of the circulating movement does not occur. This is because the sinking movement of the material is not limited to the cross-sectional area of the silo space located over the weakly aerated bottom zones. The material over adjacent bottom zones which were previously alternatingly aerated also has a certain flowability due to the preceeding aeration which allows it to participate in the sinking movement. Therefore, the volumetric part in the mixing area which participates in the mixing movement has a greater transversal extent than the bottom zones employed for its aeration do. In order for this effect to occur, the weakly aerated zones associated with the individual groups should not be separated from each other. This expression means that they should essentially be directly adjacent to each other or even overlap each other. Overlap in this connection means that a certain zone belongs to two separately operated aeration groups and is therefore always aerated when the one or the other group is operated. However, such an overlapping has generally proven to be not necessary.

The inclusion of adjacent areas in the downward movement also has the advantage that the mixing processes do not occur in an isolated manner over the individual aeration groups, but rather a cross-mixing occurs.

It is advantageous to provide not only an overflow for removing the material, but also an overflow in the area of each heavily aerated zone, so that the material can be continuously removed during the mixing process, that is, from the particular overflow located over a heavily aerated zone. The overflow system also assures that only mixed material reaches the outlet. There is no short circuit between the newly added mterial to be mixed and the outlet, because the material raised over the heavily aerated zone to the surface of the material flows down laterally to the zones which are aerated only weakly or not at all, carrying along with it the freshly added material, which is directed away from the outlet.

The material to be mixed can be added centrally. Known distributing devices can be provided over the cross section of the discharge for a more even distribution.

The ratio of the fill height to the diameter of the silo chamber is advantageously between 1 to 1.5, as is known from customary homogenizing silos which are fully fluidized.

In fully fluidized homogenizing silos the heavily aerated quadrants are usually alternated during the circulation with the weakly aerated quadrants, whereby the shift occurs on the order of every 15 minutes. In contrast thereto, the homogenizing silo of the invention should have a lower shift rate which should not be greater than 10 and preferably not greater than 6 minutes in order to assure that the material located in the vicinity of the particular zone being weakly aerated is still sufficiently movable to be able to participate in the sinking movement.

The invention is described below in more detail with reference made to the drawings, which show an advantageous embodiment.

Figure 1:
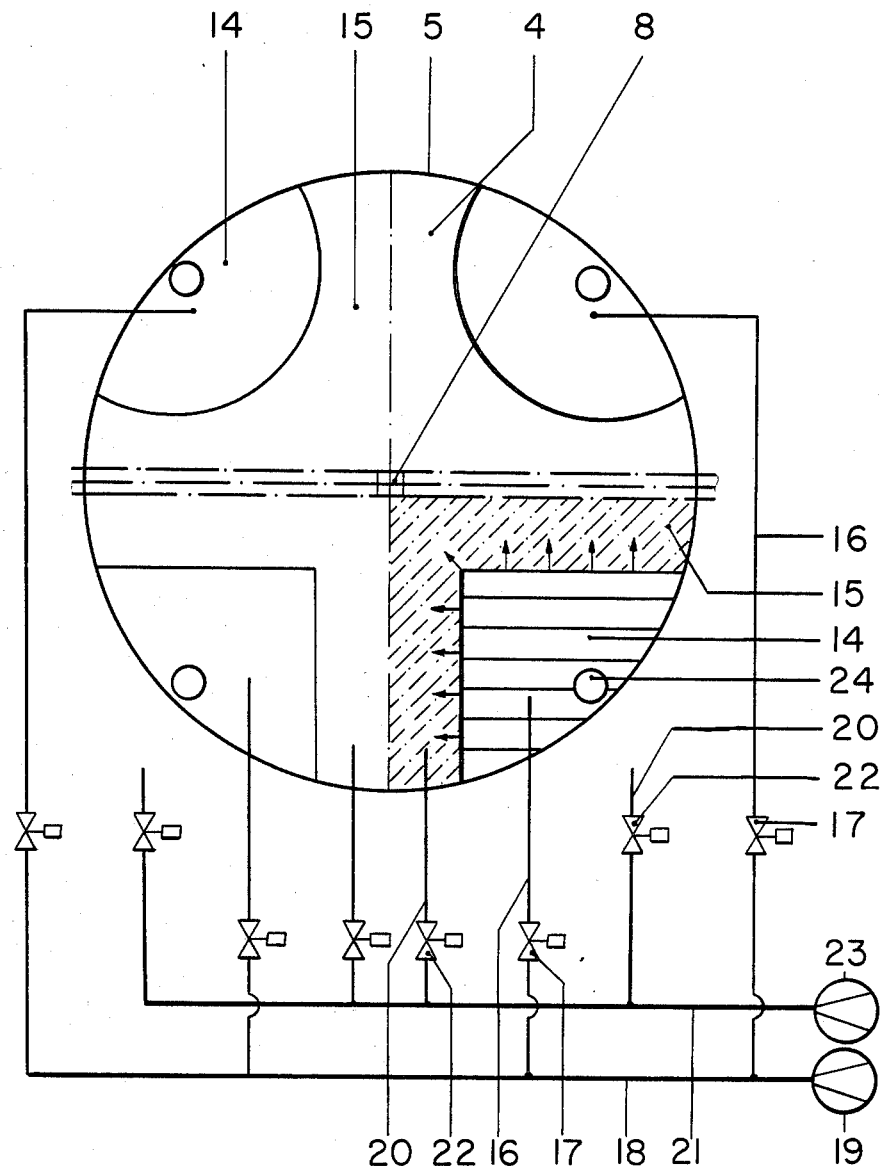
FIG. 1 shows a top view of the silo bottom.

The silo part 4 of the invention, which has cylindrical walls 5 and bottom 6 with aerating devices 7, is located on a lower silo part 1 which has bottom 2 and cylindrical wall 3 and is constructed as a storage silo. Bottom 6 is slightly inclined toward the center, where outlet opening 8 for emptying mixing silo 4 into storage silo 1 is located. During normal operation outlet opening 8 is closed. The material to be mixed can be fed into mixing silo 4 through central opening 9 in the top 10, which can be connected to a baffle plate 11 for better distribution. Filter 12 with suction blower 13 for removing loosening air is located on silo top 10.

As can be seen from the top view in FIG. 1, aeration devices 7 of the silo bottom are arranged in the form of four quadrant-like aeration fields which form one of the above groups. Each one is divided into a heavily aerated zone 14 and a more weakly aerated zone 15 which are distinguished from one another in the lower right field by different shadings. Heavily aerated zone 14 projects from the circumference into the aeration field. In the two fields shown in the lower half of the drawing it has an approximately triangular shape, while in the two upper fields it has an alternative shape which is roughly semicircular. The weakly aerated zone surrounds the heavily aerated zone in an angle pattern on its side which faces the center and the other fields. The ratio of the surface areas of the heavily aerated zones and of the weakly aerated zones is on the order of approximately 1:2 to 1:4.

The heavily aerated zones 14 of each aeration field are connected over lines 16 with solenoid valves 17 and over line 18 to a first blower 19, while the more weakly aerated zones 15 of each field are connected over lines 20 and 21 and solenoid valves 22 to a second blower 23. Blower 19 can supply air to any heavily aerated zone 14 and blower 23 can supply air to any weakly aerated zone 15. The solenoid valves are controlled in time in such a manner that only zones 14 and 15 of any one aeration field are in operation at a time, e.g. for a period of 5 minutes. Then, they are switched in such a manner that each aeration field is alternatingly actuated in a rotating pattern or in some other pattern.

Figure 2:
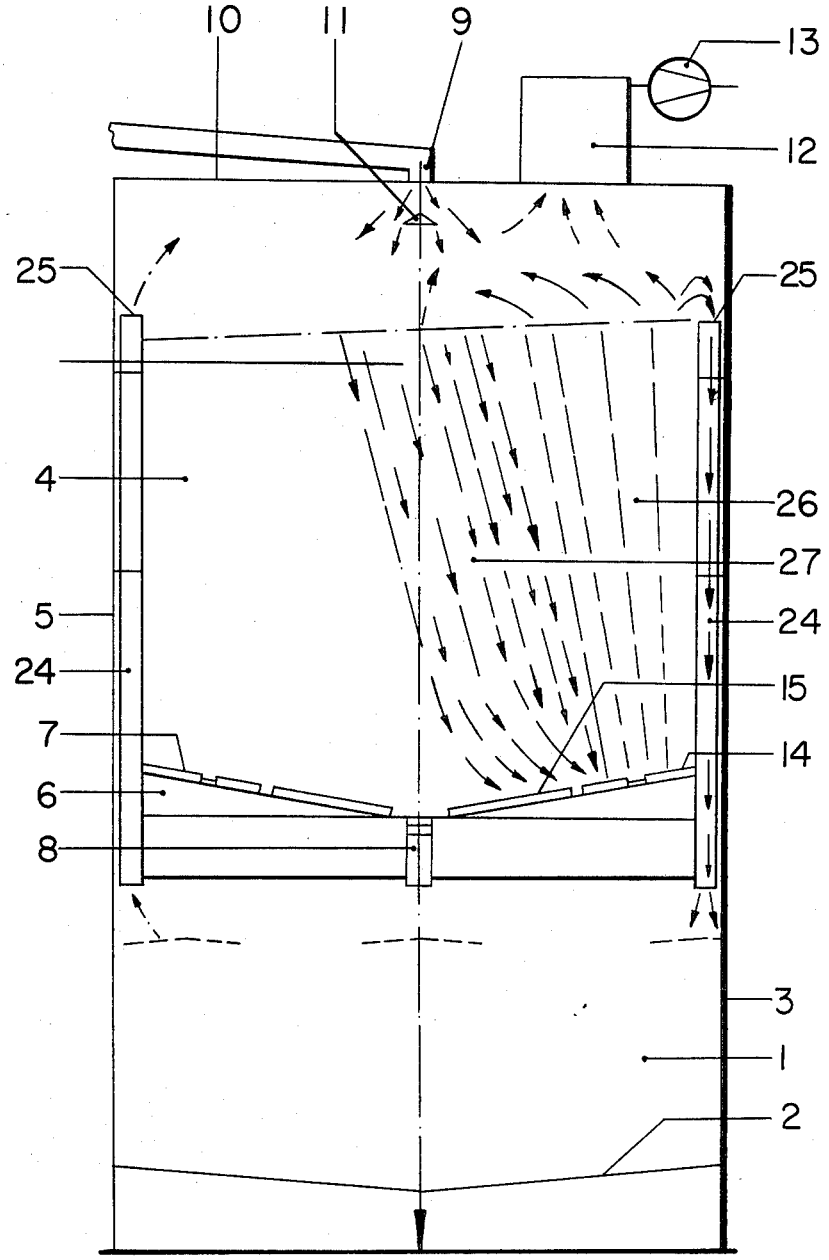
FIG. 2 shows a vertical longitudinal section through a two-story silo whose upper silo part is constructed in accordance with the invention.

Each heavily aerated zone 14 contains a vertical overflow pipe 24 near silo wall 5 whose entrance opening is located at the height of the desired fill level in the case of fluidized material. Overflow pipes 24 can be provided with closing parts which are regulated in coincidence with the change of the aeration fields. This is, however, usually not necessary, because, as is indicated in FIG. 2, the fill level over the zone which is being heavily aerated is higher than the fill level over the other zones, so that opening 25 of overflow pipe 24 is reached only here, while the openings of the other overflow pipes lie higher. While the material in the overflow pipe 24 associated with the particular aeration field in operation flows downward, as is indicated in FIG. 2, the other overflow pipes permit a counterflow of air from storage silo 1 into the upper chamber of mixing silo 4.

The air flowing at high speed during the operation of an aeration field in the heavily aerated zone into the material expands as it flows through the material located over this zone. This creates an area 26 of the material above heavily aerated zone 14 which is made quite loose by the great amount of air supplied and whose cross section increases toward the top at the expense of the less heavily aerated area 27 over the weakly aerated zone 15. This results in a circulatory flow in area 26 toward the top and in area 27 toward the bottom, because areas 28 from the material over adjacent aeration fields are included in area 27 of the sinking material. The border line between the loose material in circulation and the material not involved in the circulation runs at an angle inclined approximately 10°–15° to the vertical from the limits of the aeration zones upward and outward. The expansion of the material over the heavily aerated zone causes homogenized material on the surface to flow from the active guadrant over the unaerated quadrants. The invention makes the best possible use of this vertical and horizontal flowing of the loose material from one quadrant into the adjacent quadrant by switching much more frequently from the aeration of one quadrant to the next than is the case with known, fully fluidized quadrant homogenizing silos. While in the latter an aeration state was retained long enough to bring about a multiple circulation, in the case of the invention the shift time can be reduced so sharply that only a partial circulation occurs.

Since the amount of energy required for maintaining a circulation in partial areas of the silo contents is considerably smaller than that required for a complete homogenization, the silo of the invention can be operated continuously and yet be large enough to receive the grinding output of a time period, e.g. 8 hours, necessary to compensate long-lasting variations in composition. The silo of the invention also requires little maintenance, as it has a simple construction and the expenditure for monitoring and for transport devices is small.

The aeration in the quadrants not in operation is generally completely cut off. It can, however, be advantageous in special instances to aerate them weakly too; however, they are aerated so much more weakly than even the weakly aerated zones of the particular quadrant in operation that as regards the circulating function they can be considered as not being aerated.

It is generally advantageous to extend the heavily aerated zones right up to the silo wall. There can be instances, however, in which a narrow border zone is provided between the heavily aerated zones and the wall which zone is not aerated or is aerated only weakly.

We claim:

1. In a mixing silo for pneumatically homogenizing fine-grained material located in the bottom silo part, the improvement in the bottom area of the upper silo part comprising, groups of aeration zones (14, 15), said zones being weakly aeratable zones and heavily aeratable means wherein the weakly aeratable zones (15) are separated by a star pattern from the heavily aeratable zones (14); which are partially limited by the outer limit of wall (15), said heavily aerated zone (14) having near silo wall (5) an overflow pipe (24) containing an opening (25) located at the top of overflow pipe (24).

2. A silo according to claim 1, characterized in that an overflow opening (25) is provided each heavily aeratable bottom zone (14).

3. A silo according to claim 1 or 2, characterized in that the ratio of the fill height to the diameter of the silo chamber is between 0.7 and 1.5.

4. A silo according to claim 1, characterized by a central infeed of the material to be mixed.

5. In a process for pneumatically homogenizing fine-grained material in a mixing silo having a base with groups of aeration zones, the improvement comprising (1) heavily supplying compressed air into zones (14) to heavily aerate it, and weakly supplying compressed air into zones (15) to weakly aerate it; (2) switching the aeration from one aeration group or guadrant to another aeration group or guadrant after a period not greater than 10 minutes, and (3) continuously removing the fine-grained material from an overflow in the areas over the heavily aeratable zone to assure that only mixed material reaches the outlet; said heavily aerated zones being separated from said weakly aerated zones in a star-shaped pattern.

6. The process of claim 5, wherein the switching time is not greater than 6 minutes.

* * * * *